United States Patent [19]

DuBois

[11] Patent Number: 4,688,783

[45] Date of Patent: Aug. 25, 1987

[54] BOTTOM FEED SHEET FEEDING APPARATUS

[76] Inventor: R. Clark DuBois, 332 Wakeman Rd., Fairfield, Conn. 06430

[21] Appl. No.: 713,451

[22] Filed: Mar. 19, 1985

Related U.S. Application Data

[63] Continuation-in-part of Ser. No. 486,757, Apr. 20, 1983, abandoned.

[51] Int. Cl.[4] ..... B65H 5/00

[52] U.S. Cl. ..... 271/10; 271/225; 400/624; 400/613.2

[58] Field of Search ..... 271/9, 10, 16, 17, 19, 271/21, 109, 117, 121, 225, 241; 400/613.2, 624, 625, 629, 717

[56] References Cited

U.S. PATENT DOCUMENTS

| | | | |
|---|---|---|---|
| 223,742 | 1/1880 | Lauten | 271/10 |
| 492,218 | 2/1893 | Lux . | |
| 1,570,592 | 1/1926 | Parker | 271/10 |
| 1,659,164 | 2/1928 | Sanders | 400/717 |
| 2,219,762 | 10/1940 | Burdick et al. | 400/613.2 |
| 2,233,895 | 3/1941 | Mestre | 271/171 |
| 2,571,942 | 10/1951 | Properzi | 271/117 |
| 3,588,106 | 6/1971 | Csaba et al. | 271/10 |
| 4,353,540 | 10/1982 | Beery . | |
| 4,418,903 | 12/1983 | Landa . | |
| 4,429,863 | 2/1984 | Itoh . | |

FOREIGN PATENT DOCUMENTS

| | | | |
|---|---|---|---|
| 0036049 | 2/1984 | Japan | 271/10 |
| 2127383 | 4/1984 | United Kingdom | 271/10 |

OTHER PUBLICATIONS

IBM Tech. Disc. Bull., *Simplex/Duplex Printer*, Craft, J. A., vol. 18, No. 10, Mar. 1976, p. 3357.

*Primary Examiner*—John W. Caldwell, Sr.
*Assistant Examiner*—Alvin Oberley

[57] ABSTRACT

A sheet feeder for a bottom feed printer which comprises a housing member having legs extending therethrough which support a feeder directly on a table surface and which includes a sheet feeding mechanism in the housing which successively feeds sheets to feed rolls of the printer even though the printer is presently loaded with fanfold paper.

15 Claims, 11 Drawing Figures

FIG. 4
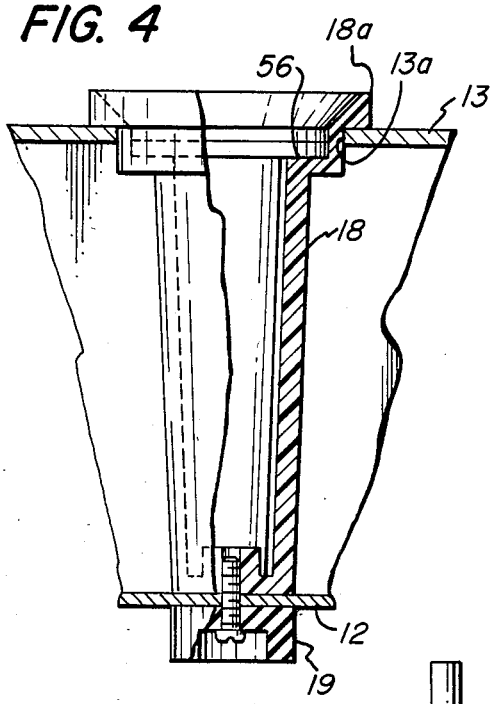
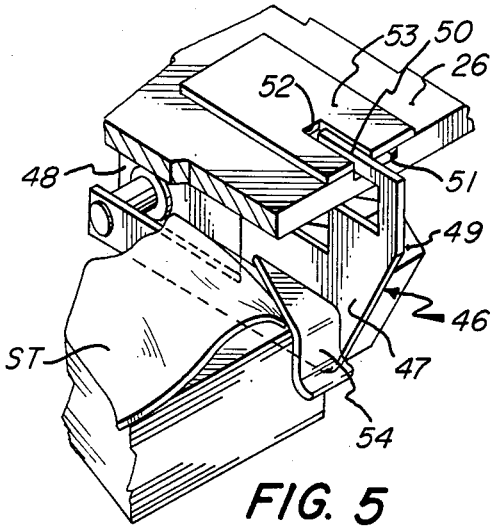
FIG. 5
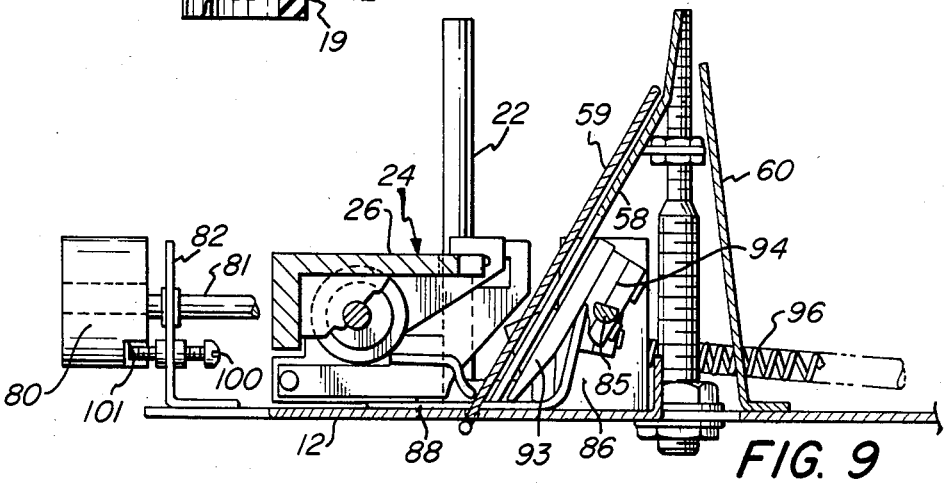
FIG. 9
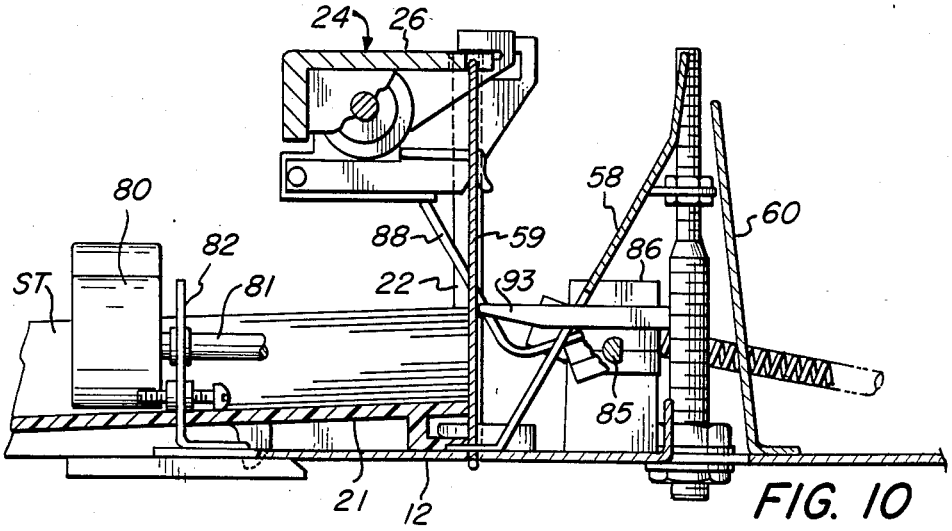
FIG. 10

BOTTOM FEED SHEET FEEDING APPARATUS

RELATED APPLICATIONS

This application is a continuation-in-part of copending application Ser. No. 486,757 filed Apr. 20, 1983, now abandoned.

FIELD OF THE INVENTION

This invention relates to paper sheet feeding apparatus and more particularly relates to an sheet feeding apparatus which successively feed sheets to a paper utilization device such as a printer.

BACKGROUND OF THE INVENTION

So-called letter quality printers are made in two general forms, either top feed or bottom feed. In top feeding printers, the paper is fed about a platen in the same manner as a typewriter, and where the printing is to be continuous, bifold paper is used in conjunction with a tractor on the printer. This arrangement requires a person to be constantly in attendance due to the possibility that the printed copy may reenter the platen and foul the printing process.

The bottom feed printers rest on a table having an opening therein and the bifold paper is fed up through the bottom of the printer to the platen or other printing surface. It is time consuming to change the normal bifold working paper to a microperforation bond which is also in bifold form when one wants to merely write a cover letter or a short document on quality paper. Usually some means is provided for inserting single sheets to the printing mechanism of the printer, however this requires a person in attendance to insert each sheet.

Accordingly, the present invention provides a new and improved bottom feed sheet feeding apparatus for use in conjunction with a bottom feed printer.

SUMMARY OF THE INVENTION

The invention is embodied in a housing upon which the printer rests. A sheet separating and feeding apparatus, as disclosed in the above-identified copending application, is preferably included in this housing. Such sheet feeding apparatus comprises a sheet separator in conjunction with a paper tray where all components necessary for sheet separating are in a vertically movable member which includes feed rollers driven by a motor through a speed reduction mechanism. The sheet separator moves only vertically on guides and always exerts a balanced predetermined weight on the sheet stack in the paper tray. Each sheet is fed individually on an upward guide to feed rolls of the printer. The paper tray extends into the bottom housing and means are provided to lift the paper separator when the supply of paper has been exhausted to reload the tray. Simultaneously with the lifting of the paper separator, a paper stop is brought into a vertical position to provide a vertical alignment surface for the leading end of the stack. A bottom opening is defined in the base of the housing together with a guide means that will permit the bottom feeding of fanfold paper through the housing and to the feed rollers of a printer which rests on the housing. This arrangement permits the feeding of the single sheets simultaneously with the fanfold paper so that the fanfold paper does not have to be taken out of the printer and then reloaded after use of only a few single sheets.

Moreover, two devices embodying the invention may be stacked and paper fed from one through the other to the feed rollers of a printer. The tray of one device may contain letterhead and the tray of the other device equal quality second sheets.

An object of this invention is to provide a new and improved sheet feeding device for use in combination with a device which loads from the bottom.

Another object of this invention is to provide a new and improved bottom feed sheet feed device for a printer which will feed individual sheets to a printer which will not interfere with fanfold paper already loaded in the printer.

A further object of this invention is to provide a new and improved sheet feeding device for a bottom feed printer which supports the printer and directs individual sheets to the printer.

A still further object of this invention is to provide new and improved sheet feeders which may be stacked and feed individual sheets of different types of paper to a bottom loading printer.

A still further object of this invention is to provide an automatic individual sheet feeding device for a bottom feed printer which does not require an intermediate transfer mechanism to present a sheet to the printer.

The features of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

BRIEF DESCRIPTION OF THE DRAWINGS

FIG. 4 is an elevation of a feature of construction of the apparatus of FIG. 1, partially in section, as seen in the plane of lines 4—4 of FIG. 1.

FIG. 5 is an isometric view of a portion of the sheet separator of FIG. 2;

FIGS. 9 and 10 are side elevations seen in the plane of lines 9—9 of FIG. 1, showing the feeding mechanism in operative and paper loading conditions.

DETAILED DESCRIPTION OF THE PREFERRED EMBODIMENT OF THE INVENTION

Figure 1:
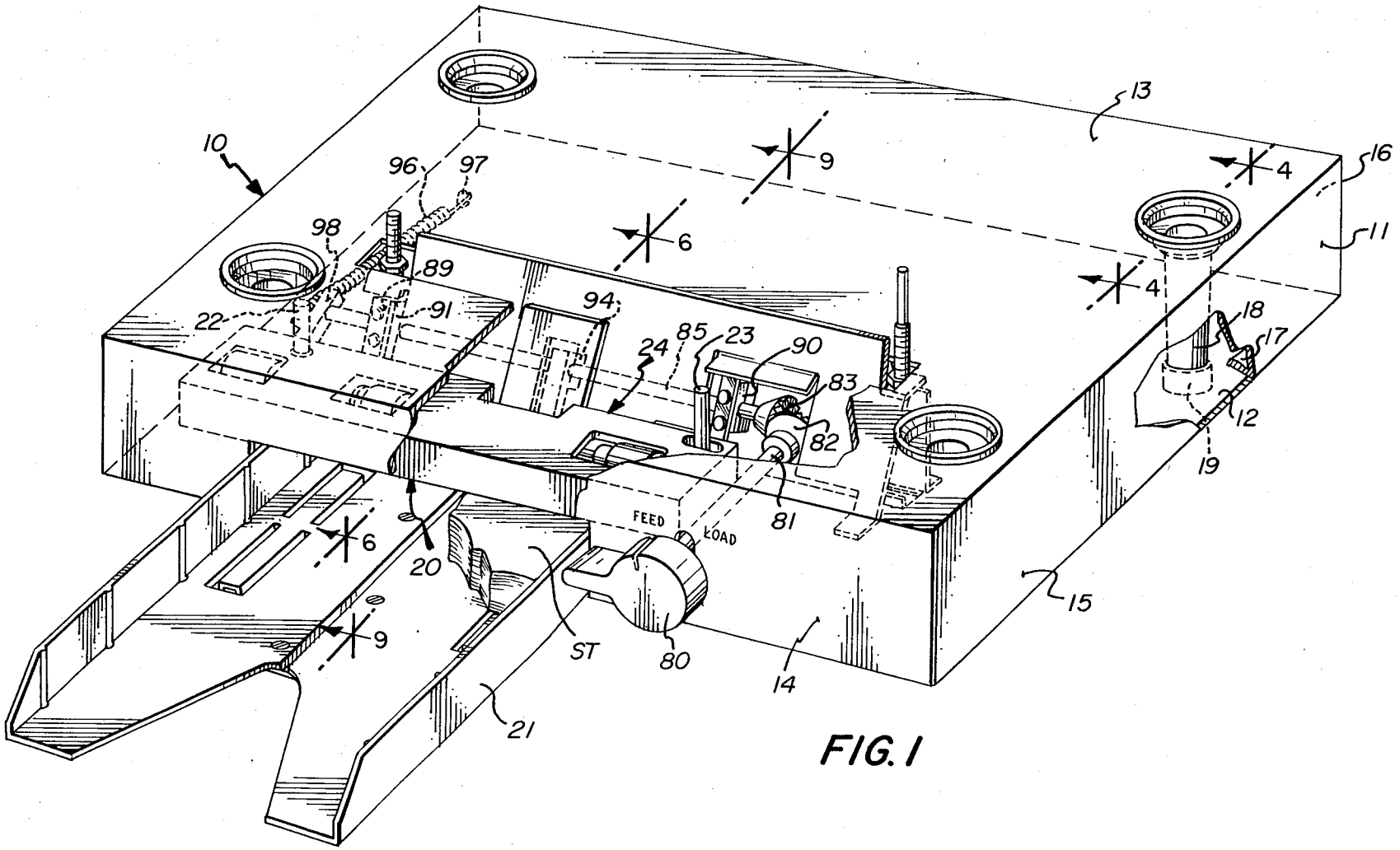
FIG. 1 is an isometric view, partially cut away of apparatus embodying the invention.

An isometric view of an apparatus generally embodying the invention, designated by the reference numeral 10, is set forth in FIG. 1. The apparatus 10 comprises a housing 11 which includes a base plate 12, top wall 13, a front wall 14, side walls 15, and a back wall 16. An inwardly directed flange 17, integral with all of the side walls, provides support for the upper portion of the housing on base plate 12. Support stands 18 (only one shown) are provided to receive and support the feet of a printer and transmit the weight of the printer directly to a support surface. A foot 19 is attached to each support stands 18 and extend below base plate 12 to rest on a support surface such as a table top. The support stands 18 are more fully described hereinafter in conjunction with FIG. 4.

An opening 20 is defined in front wall 14 to receive a paper tray 21. As shown, paper tray receives a sheet stack ST, which is shown cut away. Extending from base plate 12 are spaced apart guide rods 22 and 23 which receive thereon a sheet separator 24. Guide rods 22 and 23 permit vertical movement of separator 24 thereon.

Figure 2:
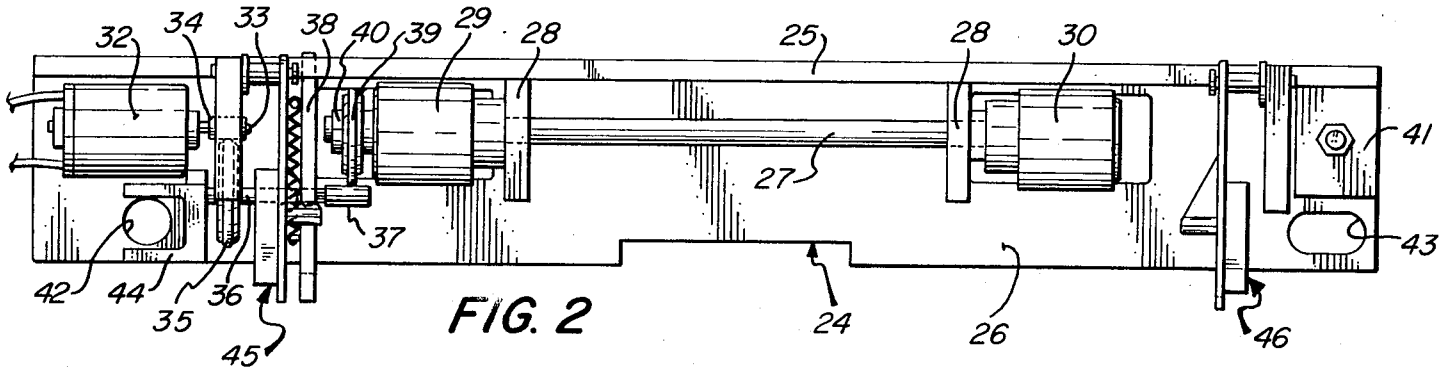
FIG. 2 is an enlarged bottom view of a sheet separator of the apparatus of FIG. 1.

Reference is now made to FIG. 2 which is a bottom view of the sheet separator 24. Separator 24 has a frame which comprises a front wall 25 and a top wall 26. A shaft 27 is journaled in spaced apart bearing blocks on top wall 26 and carries feed rollers 29 and 30. A motor 32 carried by the separator frame drives a roller pinion 34 which frictionally engages a wheel 35 on shaft 36. At the other end of shaft 36 is a pinion 37. Shaft 36 is journaled in a support mounting 38. Pinion 37 frictionally engages a wheel 39 on a one-way clutch 40 on shaft 27. One-way clutch 40 permits the shaft 27 and rollers 29 and 30 thereon to free wheel but prohibits reverse rotation of shaft 27. A weight 41 is secured to the separator frame to balance the weight of the motor and drive. Thus the rollers 29 and 30 exert equal pressure on a paper stack ST. An opening 42 adapted to receive guide rod 22 is defined at one end of top wall 26. An elongated opening 43 is in the other end of top wall 26 to receive guide rod 23. A vertically extending U-shaped member 44 provides an extended guide way for guide rod 22.

Separator 24 carries paper edge corner separator mechanisms 45 and 46 which are more clearly shown in FIG. 5. Each of these mechanism 45 and 46 comprises a member 47 pivotally mounted to a bracket 48 depending from top wall 26 and also carries a weight 49 thereon so that a predetermined weight is exerted on the leading corners of the paper stack. Member 47 further includes a motion limiting arm 50 received in a recess 51 in top wall 26 and a guide 52 in a plate member 53. A sheet corner tang 54 is carried on member 47. These corner edge separators including the tangs prevent more than one sheet of paper from being fed at a time.

Figure 3:
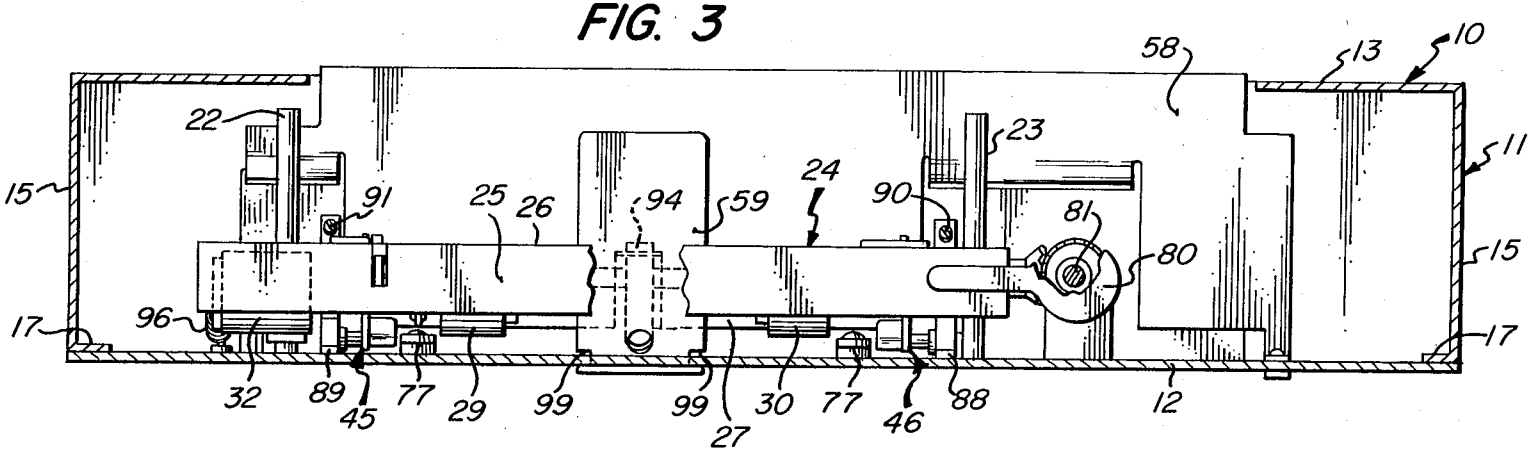
FIG. 3 is a front elevation of the apparatus of FIG. 1 with the front wall thereof removed and showing the sheet separator of FIG. 2.

Reference is now made to FIG. 3 which is a front view of the device of FIG. 1 with the front wall 14 removed. This view exemplifies how the separator 24 may move vertically on guide rods 22 and 23 as the paper stack ST is expended, and will be hereinafter referenced as the description of the invention proceeds. This view shows an upward paper guide 58 and a movable loading stack alignment member 59, as will hereinafter be decribed.

FIG. 4 exemplifies the printer supports 18 of FIG. 1. As previously described, the printer supports 18 are secured to feet 19 beneath base plate 12 by means of a screw. The printer supports extend through openings 13*a* in top wall 13 and provide a socket 56 to receive the feet of a printer thereon, as hereinafter shown in FIG. 6. Sockets 56 are partially defined by an annular flange 18*a* extending above top wall 13. The flanges 18a serve to secure top wall 13 and the side walls to base 12. The support stands 18 provide sockets 56 which receive the feet F of a printer. The supports 18 extend to openings 13a in top wall 13 of housing 11. The weight of a printer P is received through supports 18 to feet 19.

Figure 6:
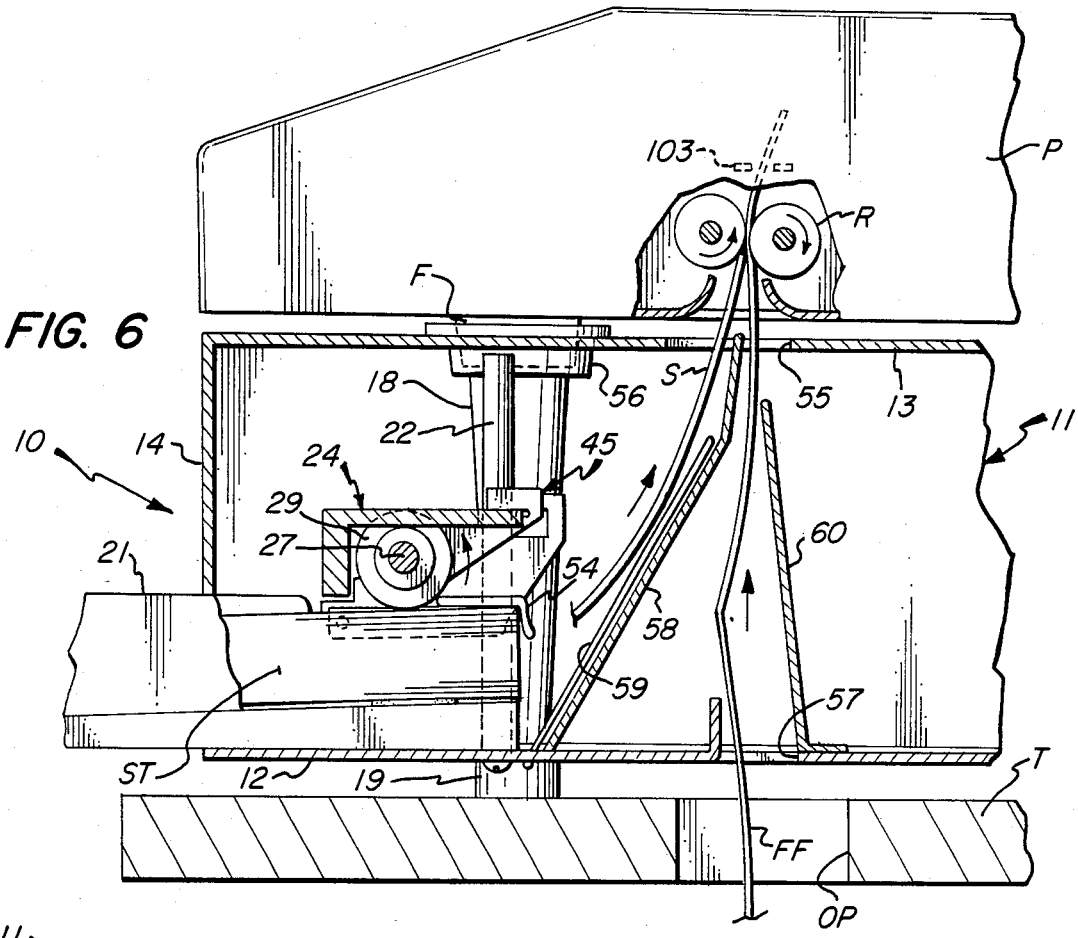
FIG. 6 is a sectional view seen in the plane of lines 6—6 of FIG. 1 where the apparatus of FIG. 1 is resting on a table and supports a paper utilizing device thereon.

Reference is now made to FIG. 6. The housing 11 is shown resting on a table top T on feet 19. Table T is of the type which has an opening OP to permit feeding of fanfold paper FF to the feed rollers R of a bottom feed printer P having feet F which rest in cups 56 defined on member 18. The printer exemplified is one manufactured by Data South Computer Corporation of Charlotte, N.C. This arrangement permits the weight of the printer to directly rest on the table T, thereby reducing noise and eliminating the need for a heavy feeder housing. An opening 57 is defined in base plate 12 to permit the entrance of fanfold paper FF into housing 11. Both the fanfold paper and the paper from tray 21 exit housing 11 through an upper opening 55 defined in top wall 13.

As a sheet of paper S is fed from stack ST by separator 24, it encounters an inclined plate member 58 extending from base 12 which directs the sheet S through upper opening 55 to printer feed rollers R. A guide member 60 also extends upwardly from base 12 and together with plate 58 defines a guide for sheets entering housing 11 through bottom opening 57 upwardly to top opening 55 and the nip of feed rolls R. With this arrangement two of the devices 10 may be stacked and have two different types of sheets ready to be selectively fed to the printer.

Figure 7:
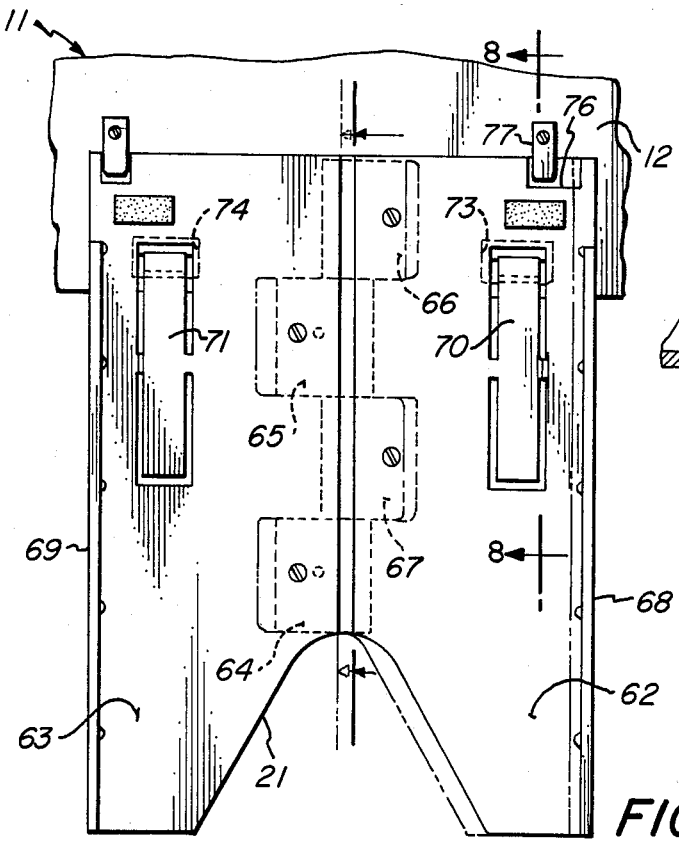
FIG. 7 is a plan view of a paper tray of the apparatus of FIG. 1 showing the tray coupled to the apparatus of FIG. 1.
Figure 8:
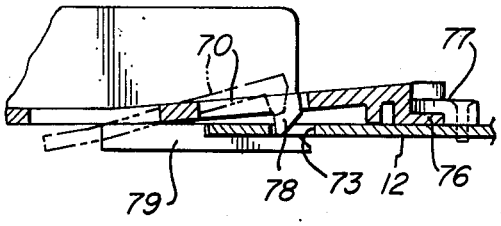
FIG. 8 is a sectional view seen in the plane of lines 8—8 of FIG. 7.

Reference is now made to FIGS. 7 and 8 which exemplify tray 21 and its manner of attachment to the housing 11, and more specifically to base plate 12. Tray 21 comprises two halves 62 and 63. Tray half 62 has fingers 64 and 65 thereon which interdigitate with fingers 66 and 67 on tray half 63. Each tray half 62 and 63 has upright side walls 68 and 69, respectively. The tray is preferably made of a plastic material which has some resilience. Latching members 70 and 71 are defined in tray halves 62 and 63, respectively, and are adapted to be received in opening 73 and 74 defined in base plate 12 near the edge thereof. The floor of tray 21 extends beyond side walls 68 and 69 and has fingers 76 extending therefrom which are received in positioning stops 77 on base plate 12. As shown in FIG. 8, latching noses 78 are defined on latching members 70 and 71 which latch in openings 73 and 74 in base plate 12. An L-shaped arm 79 further depends from the bottoms of the tray halves 62 and 63 to secure tray 21 to base plate 12. The pressure exerted on latching noses 78 will cause the latching members to pivot slightly upwards as the tray is inserted onto base plate 12. To remove the tray, one merely depresses the rear ends of the latching members 70 and 71 and slides the tray from base plate 12. The provision of the interdigitated fingers 64–67 on the tray halves 68 and 69 permits the tray to be adjusted either for eight and one-half inch paper or the European eight and one-quarter inch paper. Screws extend through each of the tray halves to the fingers of the other tray half and two screw holes are provided in each of fingers 64–67 to determine the overall width of tray 21.

Reference is now made to FIGS. 9 and 10 in conjunction with FIGS. 1 and 3. A loading control knob 80 is mounted on a shaft 81 which is pivotally received in an upstanding bracket 82 on base plate 12. Shaft 81 carries on the opposite end thereof a bevel gear 82 (FIG. 1), which meshes with a bevel gear 83 on a shaft 85 essentially perpendicular to shaft 81. Shaft 85 is rotatably mounted in spaced apart supports 86 (only one shown in FIG. 10). Carried on shaft 85 are spaced apart sheet separator lifting arms 88 and 89 mounted on carriers 90 and 92 (FIG. 1) on shaft 85. A paper stop lifting arm 93 is on a carrier 94 on shaft 85. An over center spring 96 is anchored to base plate 12 about a pin 97 and attached to an arm 98 on shaft 85. Spring 96 acts to hold shaft 85 in either of its two positions.

FIG. 9 shows this mechanism with the sheet separator 24 in its lower most position after exhausting a paper stack, while FIG. 10 shows the sheet separator in an elevated position to permit the reloading of a paper stack ST in tray 21.

With sheet separator 24 in the feeding position, as shown in FIG. 9, paper stop 59 rests against paper guide 58, as also shown in FIGS. 1 and 6.

When control knob 80 is pivoted to the load position (FIG. 1), shafts 81 and 85 rotate a limited distance. Arms 88 and 89 move upwardly to engage separator 24 on either side of tray 21. Paper stop lifting arm 93 moves the paper stop 59 out and holds it against the separator. Paper stop 59 thus provides an alignment or reference surface for use in the loading of paper into tray 21 into a position to be operatively acted upon by sheet separator 24. As shown in FIG. 3, paper stop 59' extends through the bottom of base plate 12 and has shoulders 99 resting on base plate 12. Pressure due to feeding of a single sheet of paper is sufficient to move paper stop 59 back to the position shown in FIG. 9 when control knob 80 is returned to the feed position, as shown in FIG. 1 and paper stop arm 93 is retracted.

A stop screw 100 received in bracket 82 extends into a limit recess 101 in control knob 80 and limits the degree of rotation of knob 80 and hence, shaft 81, to the feed and load positions.

A paper sensor in the form of a photo sensor 103 (FIG. 6) is positioned just beyond feed rollers R of the printer P to sense when a sheet of paper from the feeder has entered the printer. The photo sensor may be of the through transmission type, as shown, or arranged to be reflective and sensitive to detect the leading edge of a sheet S. When a sheet of paper S has entered and passed feed rollers R, sensor 103 will then de-energize sheet separator motor 32. However, the feed rollers R will continue to pull the sheet S into the printer. This is permitted by one way clutch 40.

Figure 11:
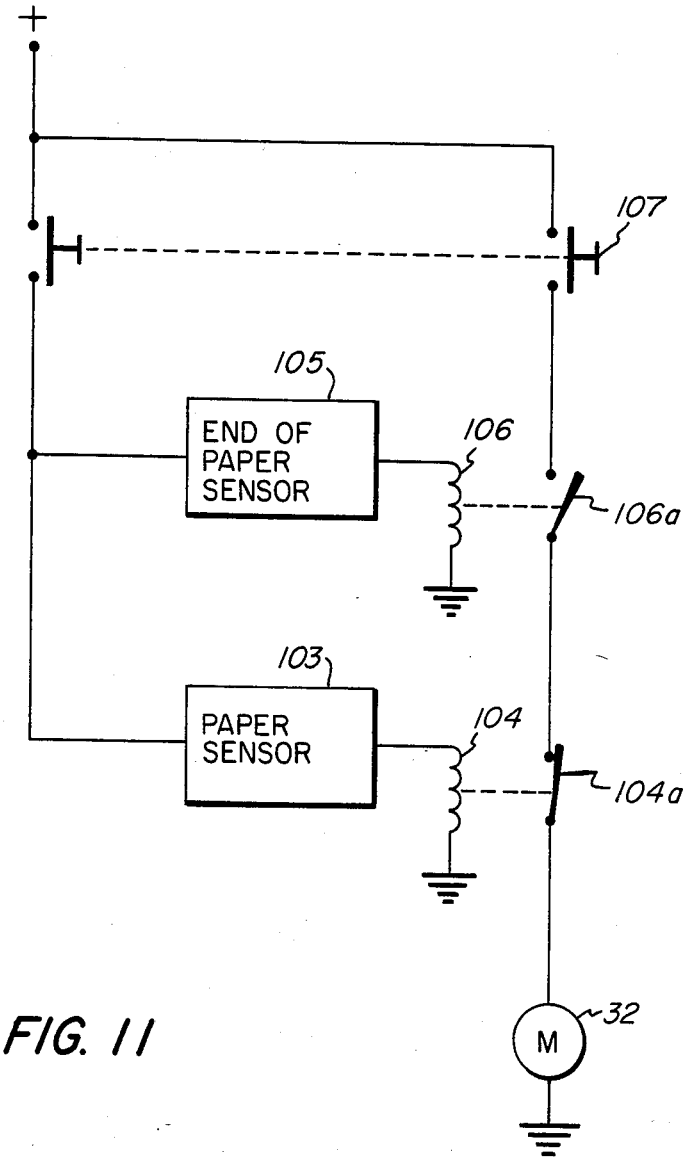
FIG. 11 is a schematic diagram set forth to show a method of controlling the operation of the sheet separator motor.

FIG. 11 is a schematic diagram exemplifying the control of the motor 32 on sheet separator 24. The paper sensor 103 provides an output to a relay 104 having a normally closed contact **104*a* in the motor circuit. An end of page sensor 105 in the printer, which may be photo electric, will sense the lack of a sheet S in the printer and operate a relay 106 having a normally open contact 106*a*. An off-on switch 107 initiates operation of the feeder. When switch 107 is closed and sensor senses that a paper sheet is needed in the printer, relay 106 will be energized, closing its contacts 106*a* to provide a closed circuit for motor 32. When sensor 103 senses the leading edge of a paper sheet S entering in the printer, it will energize relay 104 and drop out contact 104*a* to deenergize motor 32. At this time, the paper is in the feed rolls R of the printer, which are rotating at the same speed as rollers 29 and 30. By virtue of the one way clutch 40, the rollers R may pull the paper sheet S while the rollers 29 and 30 on the sheet separator free wheel. When the printer ejects the printed sheet, sensor 105 will again cause relay 106 to pick-up its contact 106*a* and energize motor 32. This operation continues until all required pages are printed and switch 107** is open. In this mode of operation, the inexpensive fanfold paper is also fed, but not printed upon.

The dimensioning is such that the two sheet feeding apparatuses embodying the invention may be stacked with a printer on top. Even three may be stacked if the lower sheet feeder utilizes legal size paper. Assuming that the printer is arranged as shown in FIG. 6 to receive the lower quality fanfold paper, and the printer operator does not want to unload the fanfold for loading of sheet stock, a system embodying the invention is merely operated as described to successively feed individual sheets which go through the rollers with the fanfold paper. When the document on the individual sheets has been completed, the printer operator will merely discard the unused fanfold paper and if no further documents are to be printed on the individual sheets, the printer operator will open switch 107 to set the printer back for continuous operation on the fanfold paper.

It may thus be seen that the objects of the invention set forth, as well as those made apparent from the foregoing description, are efficiently attained. A preferred embodiment of the invention have been set forth for purposes of disclosure, however, modifications to the disclosed embodiment of the invention, as well as other embodiments thereof, may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A sheet feeder for a bottom feed printer comprising a housing member having a base and a top wall and side walls, an opening defined in said top wall, said housing adapted to locate a printer thereon so that a sheet of paper may be fed to feed rolls of the printer through said opening in said top wall, said housing member defining an opening therein adapted to receive a paper tray, a paper tray adapted to receive a stack of individual sheets of paper, means for coupling said tray to said housing, a sheet separator in said housing having drive rolls for removing the top sheet from a sheet stack in said tray and feeding the top sheet from the stack, linear guide means extending essentially vertically from the base of said housing member, said sheet separator including means engaging said guide means so that said separator may move linearly and essentially vertically thereon, means in said housing for directing a sheet of paper fed from said tray by said separator to said opening in said top wall, and means in said housing member for lifting said separator to permit loading of sheets in said tray, said means for lifting comprising, a shaft rotatably mounted in said housing and having arms engagable with said separator on either side of said tray to lift said separator and permit loading of sheets in said tray, and means extending exteriorly of said housing for rotating said shaft to lift said separator.

2. The feeder of claim 1 where said housing includes a plurality of legs extending from said base to openings in said top wall, said legs being arranged to locate feet of the printer with respect to said housing and support said printer thereon.

3. The feeder of claim 1 further including means operated in conjunction with said means for lifting to move to a vertical position and provide an alignment surface for sheets loaded into said tray.

4. The feeder of claim 1 where said means in said housing for directing is an upwardly inclined guide member, a plate member normally resting on said guide member, another arm on said rotatable shaft, said another arm adapted to engage said plate and move it to an essentially vertical position when said separator is raised so that said plate provides an alignment surface for the leading edge of a sheet stack loaded into said tray.

5. The feeder of claim 1 where an opening is defined in said base for passage of sheets therethrough, and guide means cooperating with said means for directing for guiding a sheet from the opening in said base to said opening in said top wall.

6. A sheet feeder for a bottom feed printer comprising a housing member having a base and a top wall and side walls, an opening defined in said top wall, said housing member adapted to locate a printer thereon so that a sheet of paper may be fed to feed rolls of the printer through said opening in said top wall, said housing defining an opening therein adapted to receive a paper tray, a paper tray adapted to receive a stack of individual sheets of paper, means for coupling said tray to said housing, linear guide means extending essentially vertically from the base of said housing member, a sheet separator for removing the top sheet from a sheet stack in said tray, said sheet separator including means engaging said guide means so that said separator may move linearly and essentially vertically thereon, a feed roller rotatably mounted on said said separator and positioned to engage the top sheet of a stack and feed roller drive means including a motor on said separator, said separator arranged to rest on a sheet stack through said feed roller and move linearly on said guide means as the sheet stack is expended, means in said housing for directing a sheet of paper fed from said tray by said separator to said opening in said top wall, and a shaft rotatably mounted in said housing and having arms thereon on either side of said tray adapted to engage and lift said separator to permit loading of sheets in said tray, and means extending exteriorly of said housing for rotating said shaft to lift said separator.

7. The feeder of claim 6 wherein a opening for sheet material is defined in said base, and guide means cooperating with said means for directing for guiding a sheet from the opening in said base to said opening in said top wall.

8. The feeder of claim 6 where said means for directing is an upwardly inclined plate member directed toward said opening in said top wall.

9. The feeder of claim 8 further including a second plate member normally resting on said means for directing and means operated by said rotatable shaft for moving said second plate member to an essentially vertical position to provide an alignment surface for the leading edges of sheets loaded into said tray.

10. The feeder of claim 6 where said housing includes a plurality of legs extending from said base to openings in said top wall, said legs being arranged to locate feet of the printer with respect to said housing and support said printer thereon.

11. The feeder of claim 6 further including means operated in conjunction with said arms of said rotatable shaft to move to a vertical position and provide an alignment surface for sheets loaded into said tray.

12. The feeder of claim 2 where said legs have a flange overlying said top wall to secure said top wall and said side walls to said base.

13. The feeder of claim 10 where said legs have a flange overlying said top wall to secure said top wall and said side walls to said base.

14. The feeder of claim 1 where said tray is width adjustable.

15. The feeder of claim 6 wherein said tray is width adjustable.

* * * * *